US009273925B1

(12) United States Patent
Liao

(10) Patent No.: US 9,273,925 B1
(45) Date of Patent: Mar. 1, 2016

(54) SENSING DEVICE OF TRUE-SIMULATING BULLET MAGAZINE

(71) Applicant: Guay Guay Trading Co., Ltd., Changhua County (TW)

(72) Inventor: Yin-Hsi Liao, Changhua County (TW)

(73) Assignee: Guay Guay Trading Co., Ltd., Changhua County (TW)

( * ) Notice: Subject to any disclaimer, the term of this patent is extended or adjusted under 35 U.S.C. 154(b) by 0 days.

(21) Appl. No.: 14/529,125

(22) Filed: Oct. 30, 2014

(51) Int. Cl.

| | |
|---|---|
| ***F41A 17/36*** | (2006.01) |
| ***F41B 11/00*** | (2013.01) |
| ***F41A 9/61*** | (2006.01) |
| ***F41B 11/50*** | (2013.01) |
| ***F41A 17/00*** | (2006.01) |
| ***F41A 9/00*** | (2006.01) |
| ***F41B 11/55*** | (2013.01) |
| ***F41B 11/89*** | (2013.01) |
| ***F41A 19/58*** | (2006.01) |
| ***F41A 9/62*** | (2006.01) |

(52) U.S. Cl.
CPC . *F41B 11/55* (2013.01); *F41A 9/62* (2013.01); *F41A 17/36* (2013.01); *F41A 19/58* (2013.01); *F41B 11/89* (2013.01)

(58) Field of Classification Search
CPC ..... F41A 17/36; F41A 17/06; F41A 17/34; F41A 9/62; F41A 9/61; F41A 19/58; F41B 11/62; F41B 11/55
USPC ..... 124/40, 51.1, 52, 45, 73; 42/70.02, 50, 42/70.01
See application file for complete search history.

(56) References Cited

U.S. PATENT DOCUMENTS

| | | | | | |
|---|---|---|---|---|---|
| 4,512,100 | A * | 4/1985 | Dheur | F41A 17/36 | 42/70.05 |
| 5,272,828 | A * | 12/1993 | Petrick | F41A 9/61 | 42/50 |
| 5,301,448 | A * | 4/1994 | Petrick | F41A 9/65 | 102/201 |
| 5,711,286 | A * | 1/1998 | Petrosyan | F41B 11/62 | 124/53 |
| 5,771,875 | A * | 6/1998 | Sullivan | F41B 11/721 | 124/72 |
| 6,094,850 | A * | 8/2000 | Villani | F41A 9/62 | 42/1.02 |
| 6,457,271 | B1 * | 10/2002 | Vaid | F41A 17/36 | 42/11 |
| 6,655,066 | B2 * | 12/2003 | Fluhr | F41A 17/36 | 42/70.02 |
| 6,694,658 | B1 * | 2/2004 | Marsac | F41B 7/006 | 124/16 |
| 6,952,895 | B1 * | 10/2005 | Zonshine | F41A 17/36 | 42/18 |
| 8,156,930 | B2 * | 4/2012 | Hu | F41A 17/36 | 124/51.1 |
| 8,495,832 | B2 * | 7/2013 | Vukovic | F41A 17/36 | 42/70.02 |

(Continued)

*Primary Examiner* — Alexander Niconovich
(74) *Attorney, Agent, or Firm* — Leong C. Lei

(57) ABSTRACT

A sensing device of a true-simulating bullet magazine is disclosed. When a bullet driving element forward advance bullets, position of a movable guide bar is controlled so that when the bullets are used up or a bullet magazine get loosened, an activation element arranged at one end of the movable guide bar is triggered to cut off power supply required for a firing operation of a toy gun. As such, without modifying the toy gun and the outside appearance of a true-simulating bullet magazine, a simple structure is provided to prevent firing of the toy gun under a condition of no bullet loaded so as to reduce the potential risk of damaging internal mechanisms of the toy gun and to achieve an effect of simulation of a real gun.

6 Claims, 13 Drawing Sheets

(56) References Cited

U.S. PATENT DOCUMENTS

| | | | | |
|---|---|---|---|---|
| 8,590,200 | B2 * | 11/2013 | Domian | F41A 17/36 42/70.01 |
| 8,677,880 | B2 * | 3/2014 | Bowles | F41A 9/68 42/50 |
| 8,683,725 | B2 * | 4/2014 | Munson | F41A 17/38 42/6 |
| 8,935,872 | B2 * | 1/2015 | Zukowski | F41A 17/36 42/70.02 |
| 9,057,578 | B2 * | 6/2015 | Liao | F41B 11/55 |
| 2005/0000138 | A1 * | 1/2005 | Kiss | F41A 17/36 42/50 |
| 2010/0043766 | A1 * | 2/2010 | Iwasawa | F41A 17/34 124/40 |
| 2010/0154763 | A1 * | 6/2010 | Su | F41A 17/36 124/40 |
| 2011/0214326 | A1 * | 9/2011 | Inskeep | F41A 9/61 42/49.02 |
| 2011/0283984 | A1 * | 11/2011 | Hu | F41B 11/57 124/77 |
| 2012/0048253 | A1 * | 3/2012 | Hu | F41A 17/36 124/73 |
| 2015/0068508 | A1 * | 3/2015 | Liao | F41B 11/55 124/45 |

* cited by examiner

SENSING DEVICE OF TRUE-SIMULATING BULLET MAGAZINE

BACKGROUND OF THE INVENTION (a) Technical Field of the Invention

The present invention generally relates to a sensing device of a true-simulating bullet magazine, and more particularly to a sensing device of a true-simulating bullet magazine that reduces the chance of damage of a toy gun by using a simple structure to constrain a firing operation of the toy gun in a condition of no bullet loaded or no magazine attached.

(b) Description of the Prior Art

To suit the needs of players who love military weapons, in a condition of no ammunition loaded, simple measures are often taken to constrain the operation of pulling a trigger by preventing it from being depressed or limiting the movement of a bolt. A common issue of such measures is numerous components must be added in such a way that the collaborative operations of these components are allowed to control the firing operations of the toy guns so as to prevent the it from shooting or simply invalid the firing.

Those known toy guns, however, suffer certain problems and drawbacks in the uses thereof and some are listed below. Further improvements thus are needed.

(1) The number of the components used is large and the operations of these components are complicated, making it extremely easy to break the combination relationships or the operations of the components simply due to hit or fall.

(2) The materials used are complicated, making the manufacture cost high and maintenance difficult.

(3) Although the firing operation is constrained, consumption of electrical power continues.

(4) There is no way for a user to identify if the next firing operation is still constrained.

SUMMARY OF THE INVENTION

The primary object of the present invention is to use a bullet driving element to control the advancing of bullets and using an activation element to control the supply of power to a toy gun and to arrange a movable guide bar between the bullet driving element and the activation element, so that when the bullet driving element has completely advanced all the bullets, the movable guide bar may trigger the activation element to cut off the supply of power of the toy gun thereby preventing firing of empty bullet, which may cause a waste of electrical power or a damage to the mechanisms.

To achieve above object, the present invention provides a structure that comprises: a movable guide bar that is movably mounted in a true-simulating bullet magazine, an activation element that is mounted to an end of the movable guide bar and selectively activate/deactivate power required for firing of a toy gun, and a bullet driving element that is movably arranged in the true-simulating bullet magazine to selectively contact and move the movable guide bar. When a user is playing a toy gun that includes the present invention therein, before the true-simulating bullet magazine is installed, since the activation element is not activated, no electrical connection is established in the toy gun so that no firing can be performed, meaning it is not possible to shoot. After the true-simulating bullet magazine that is loaded with bullets is installed, the activation element is immediately triggered and the bullet driving element sequentially advances the bullets to be shot out, and then, the bullet driving element contacts and moves the movable guide bar so that the activation element mounted at one end of the movable guide bar that is distant from the bullet driving element is also moved to have the activation element is triggered again to cut off the power supply of the toy gun. As such, protection of the toy gun against firing at no bullet loaded is achieved.

The present invention provides a breakthrough solution for the existing problems of the prior art toy guns and achieves the above-described advantages.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
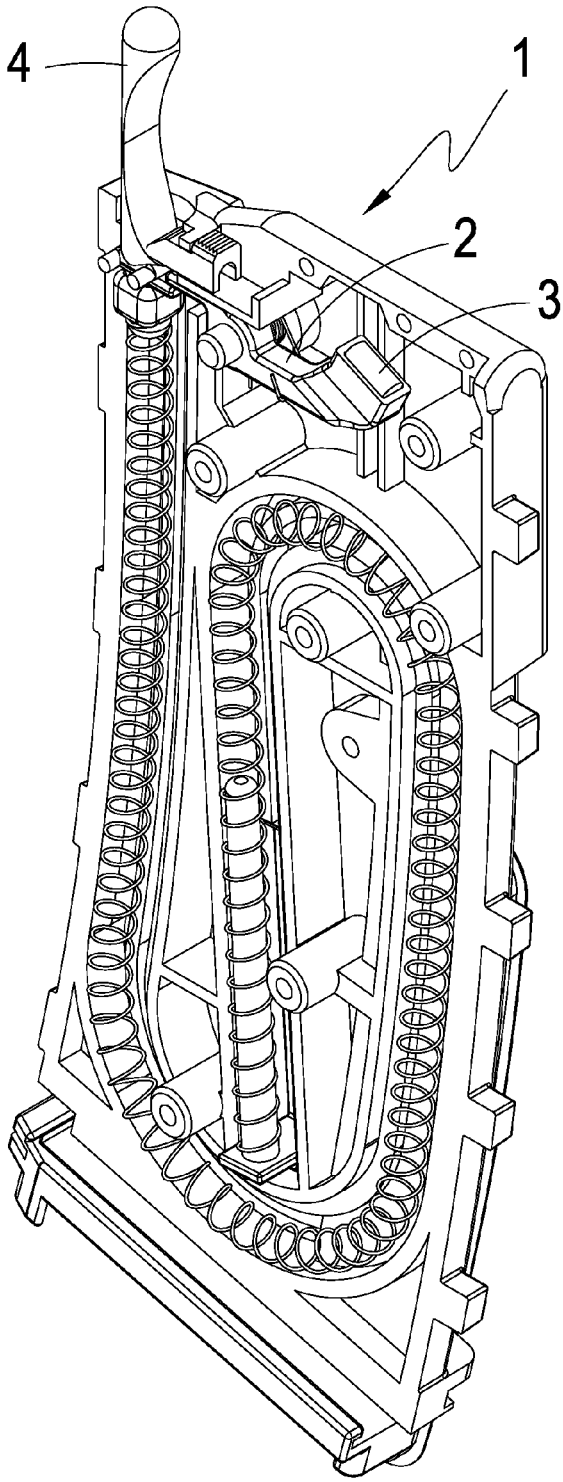
FIG. 1 is a perspective view of the present invention.
Figure 2:
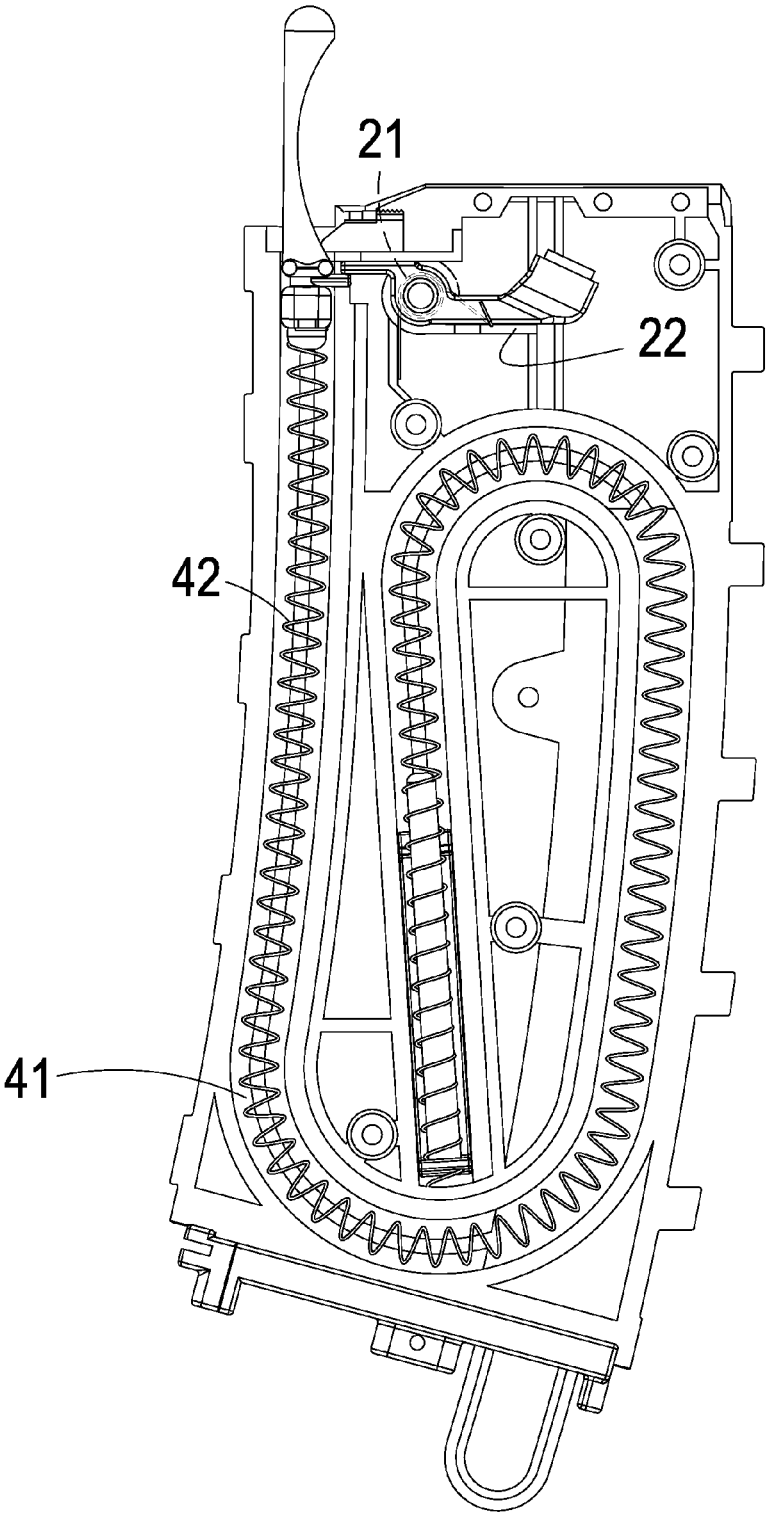
FIG. 2 is a schematic side view showing inside details of the present invention.
Figure 3:
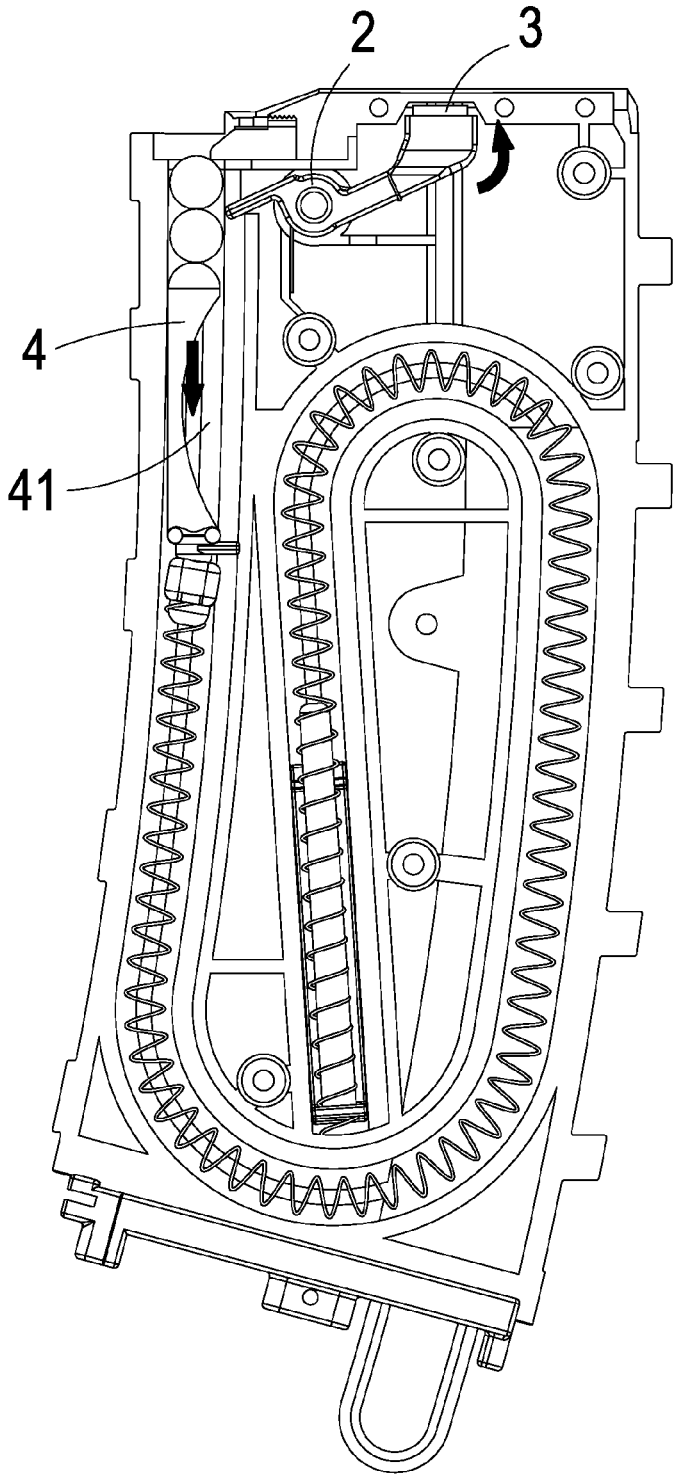
FIG. 3 is a schematic side view illustrating an operation of the present invention.
Figure 4:
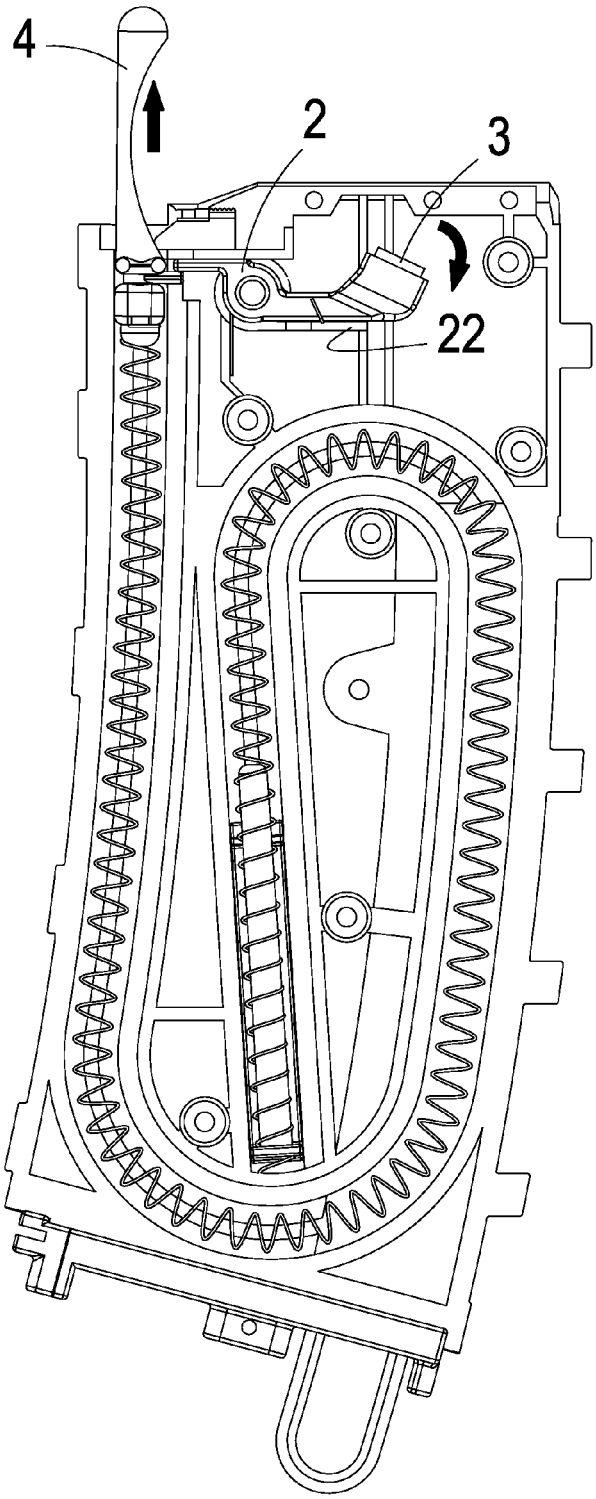
FIG. 4 is another schematic side view illustrating the operation of the present invention.

Referring to FIGS. 1 and 2, these drawings clearly show the present invention provides a sensing device of a true-simulating bullet magazine 1, which comprises:

a movable guide bar 2, which is movably mounted in the true-simulating bullet magazine 1, the movable guide bar 2 comprising a guide bar spring 21 attached thereto;

a constraint section 22, which is mounted in the true-simulating bullet magazine 1 to constrain a movement range of the movable guide bar 2;

an activation element 3, which is mounted to an end of the movable guide bar 2 to selectively activate/de-activate power required for a firing operation of a toy gun;

a bullet forwarding track 41, which is mounted in the true-simulating bullet magazine 1 for receiving bullets therein; and a bullet driving element 4, which is movably arranged in the bullet forwarding track 41 to selectively contact and move the movable guide bar 2, the bullet driving element 4 having an end that is opposite to an opening of the bullet forwarding track 41 and is provided with a bullet driving spring 42 attached thereto.

Collectively referring to FIGS. 1-4, loading bullets (where BB bullets are taken as an example for illustration) is carried out by first pressing the bullet driving element 4 into the bullet forwarding track 41 and then BB bullets are inserted, one by one, into the bullet forwarding track 41. In the insertion of first BB bullet, it can be found that the bullet driving element 4 releases the engagement thereof with the movable guide bar 2 to allow the spring force of the guide bar spring 21 to rotate the movable guide bar 2 in such a way that the activation element 3 that is mounted to the opposite end of the movable guide bar 2 is caused to contact an inner wall of the true-simulating bullet magazine 1. However, before the true-simulating bullet magazine 1 is installed, electrical power of the toy gun is not activated, meaning the activation element 3 may detect the no magazine loaded condition and prevent firing from be performed. When BB bullets are completely loaded and the true-simulating bullet magazine 1 is then installed, the activation element 3 is triggered so as to establish electrical connection of a driving motor of the toy gun to allow an operation to be normally carried out by a user. At the moment when the last one of the BB bullets is shot, the bullet driving element 4 is once against brought into contact with and thus moves the movable guide bar 2 to set the movable guide bar 2 resting on one side of the constraint section 22 so that the activation element 3 breaks the electrical connection of the toy gun to interrupt the supply of power for next firing thereby preventing firing from being performed in a condition of no bullet loaded.

Figure 5:
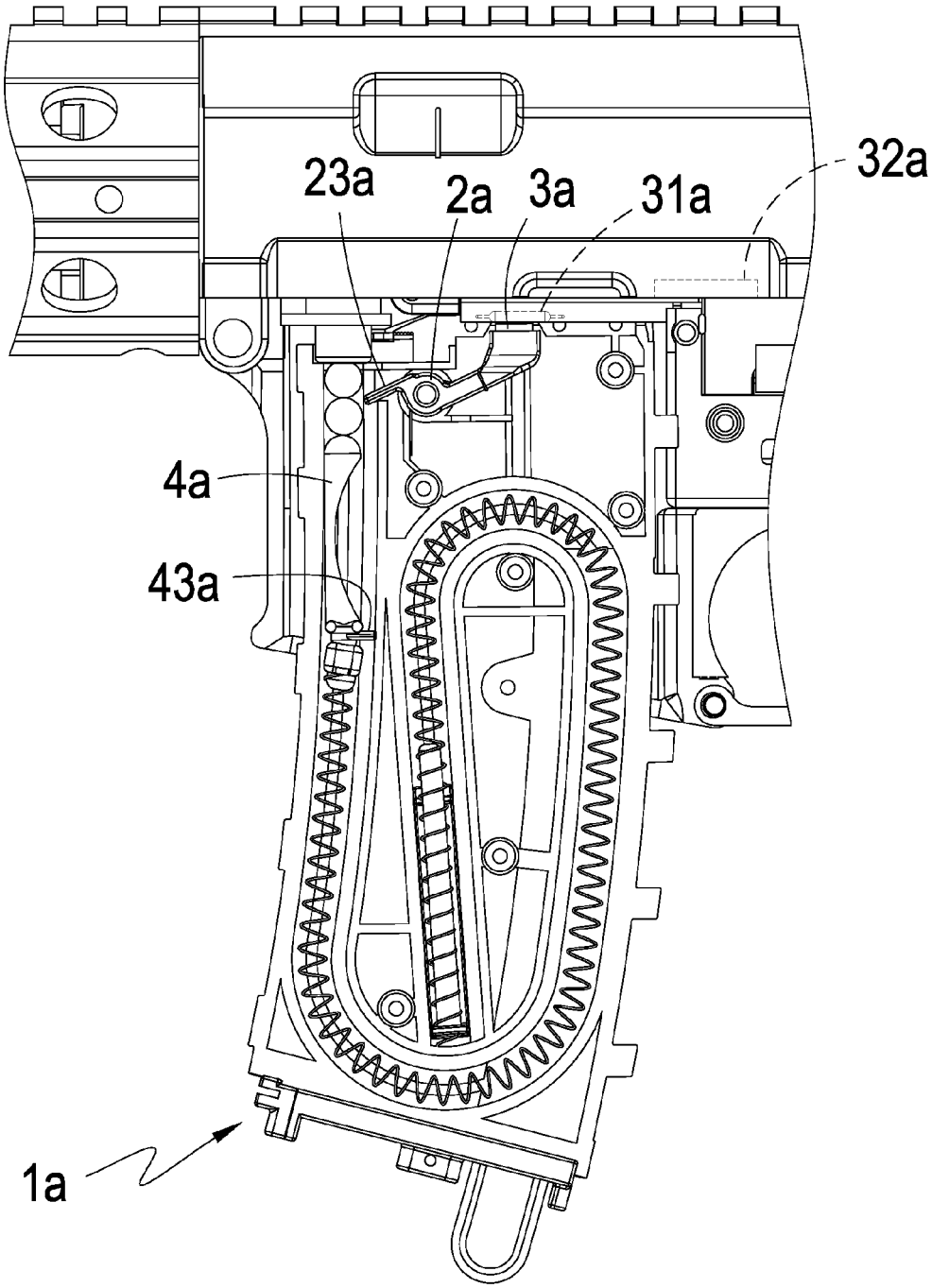
FIG. 5 is a schematic side view showing inside details of another embodiment of the present invention.
Figure 6:
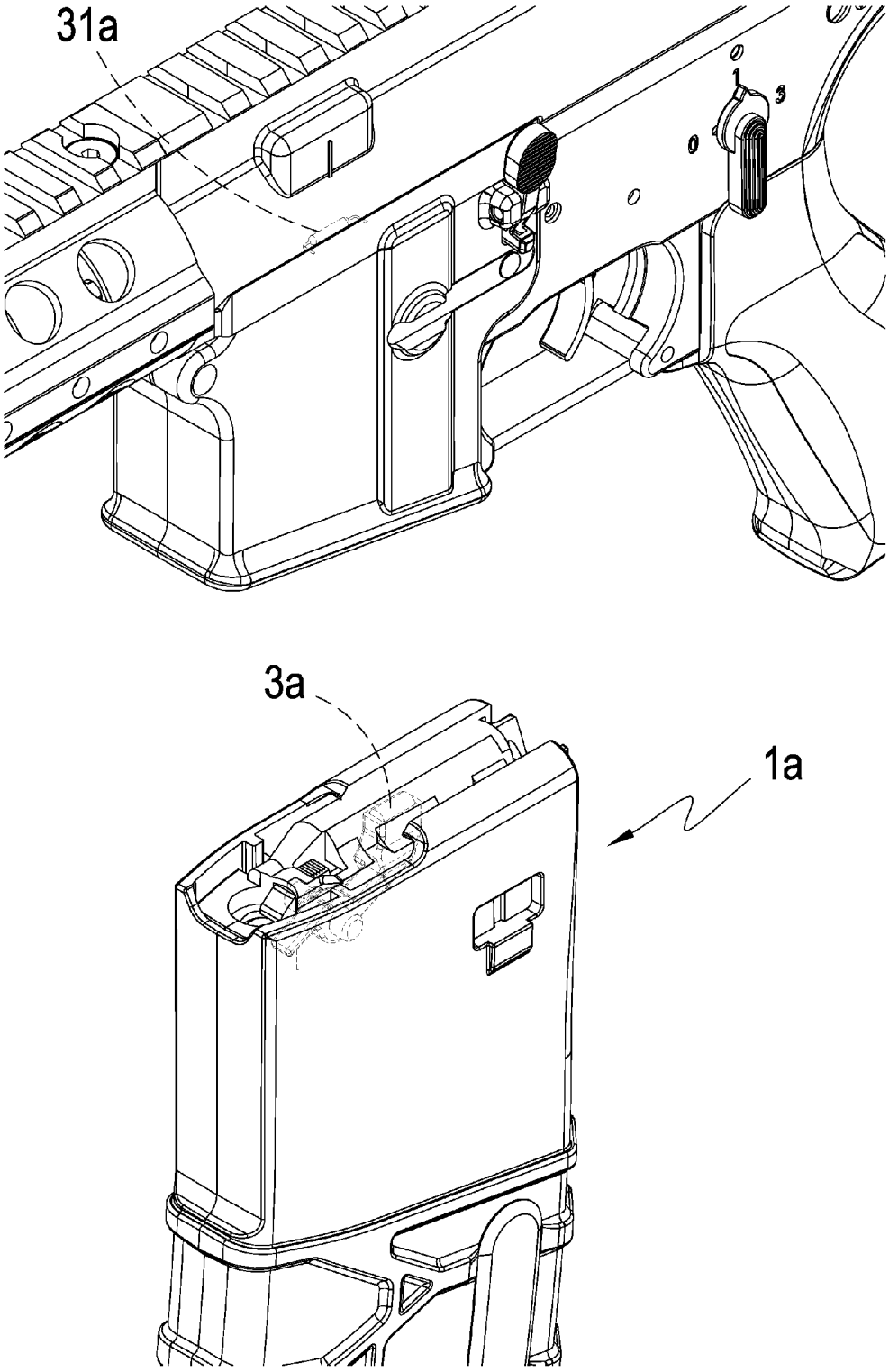
FIG. 6 is a schematic side view illustrating a condition of use of said another embodiment of the present invention.
Figure 7:
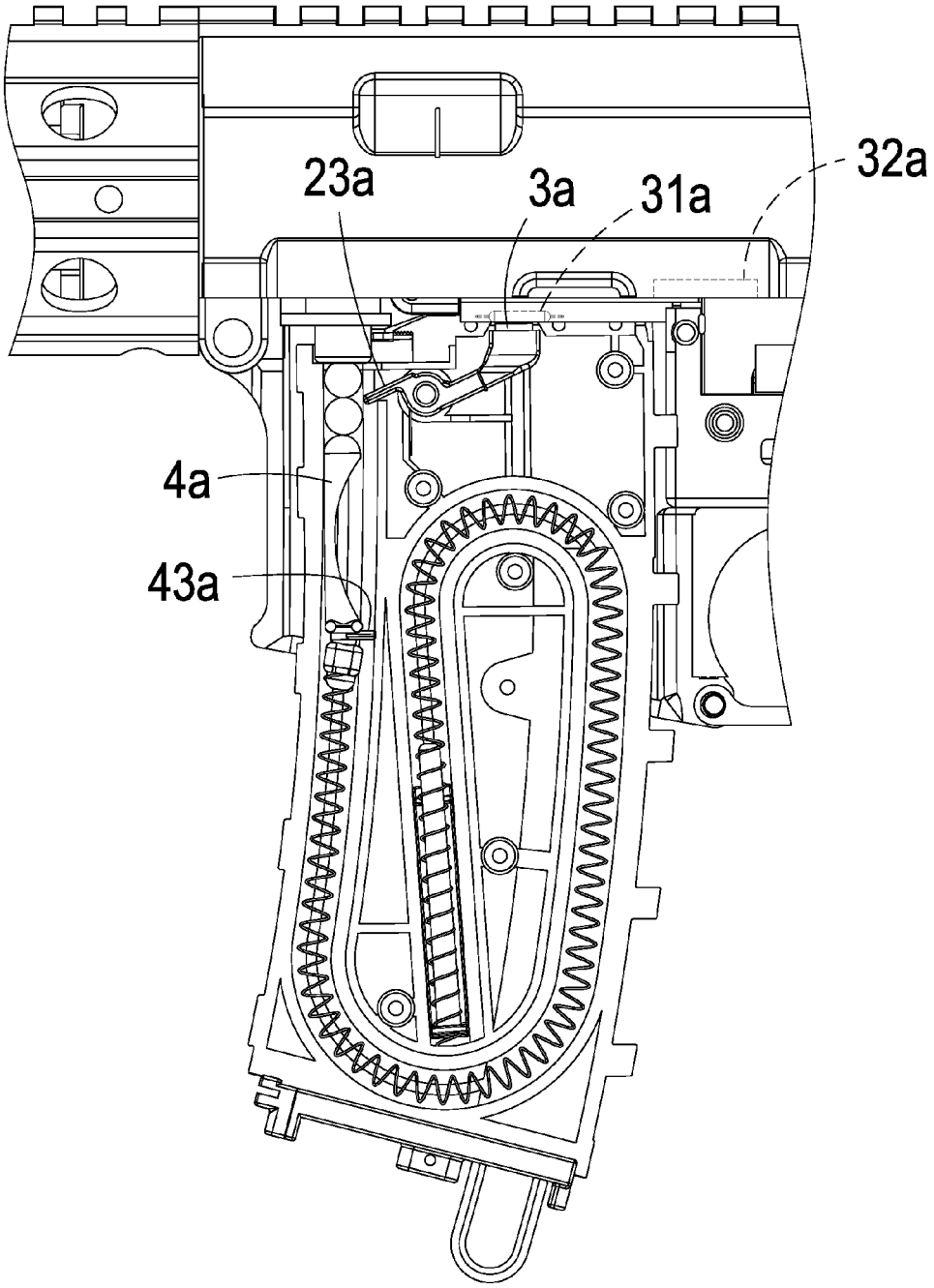
FIG. 7 is another schematic side view illustrating the condition of use of said another embodiment of the present invention.
Figure 8:
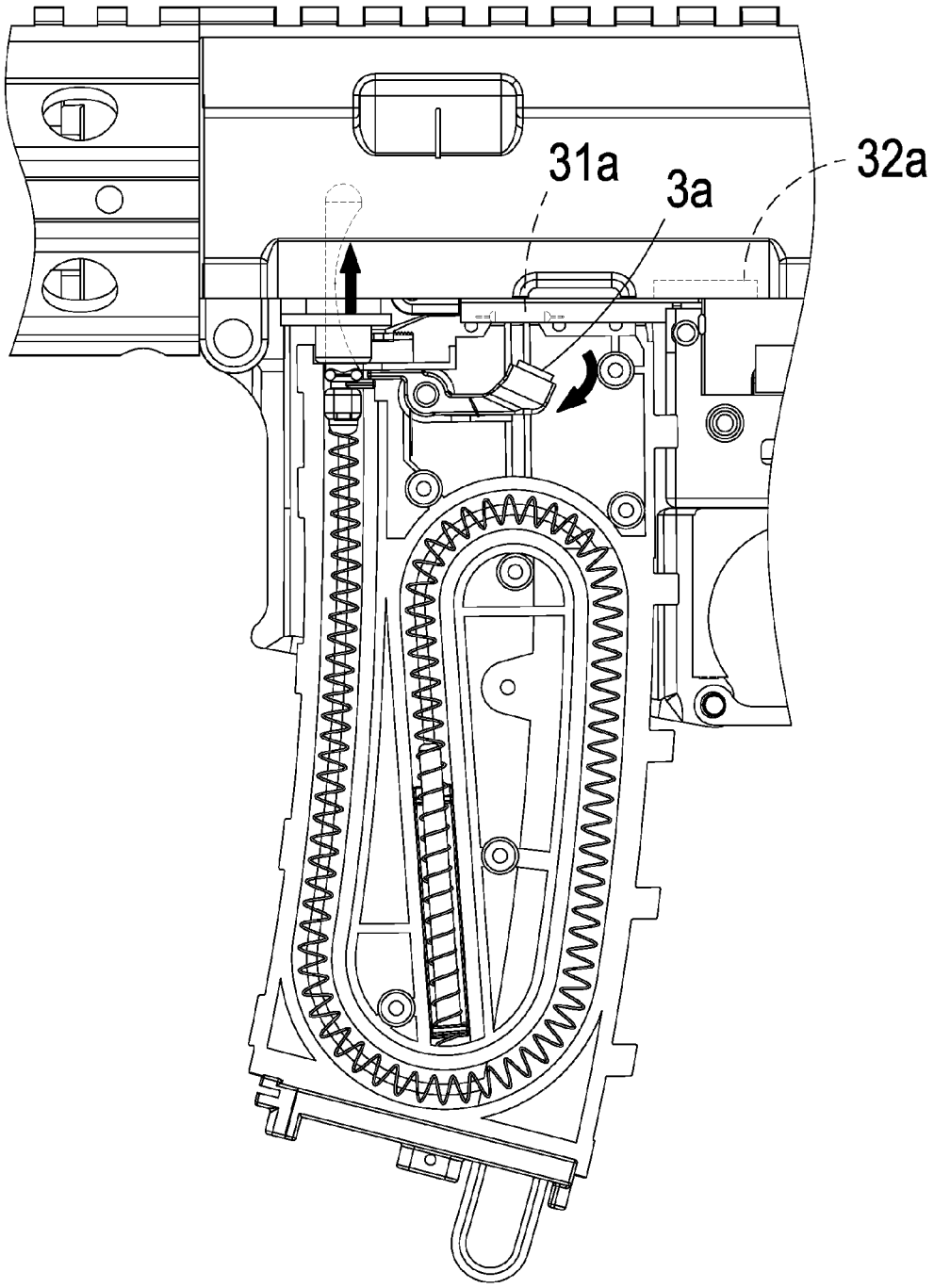
FIG. 8 is a schematic side view illustrating an operation of said another embodiment of the present invention.
Figure 9:
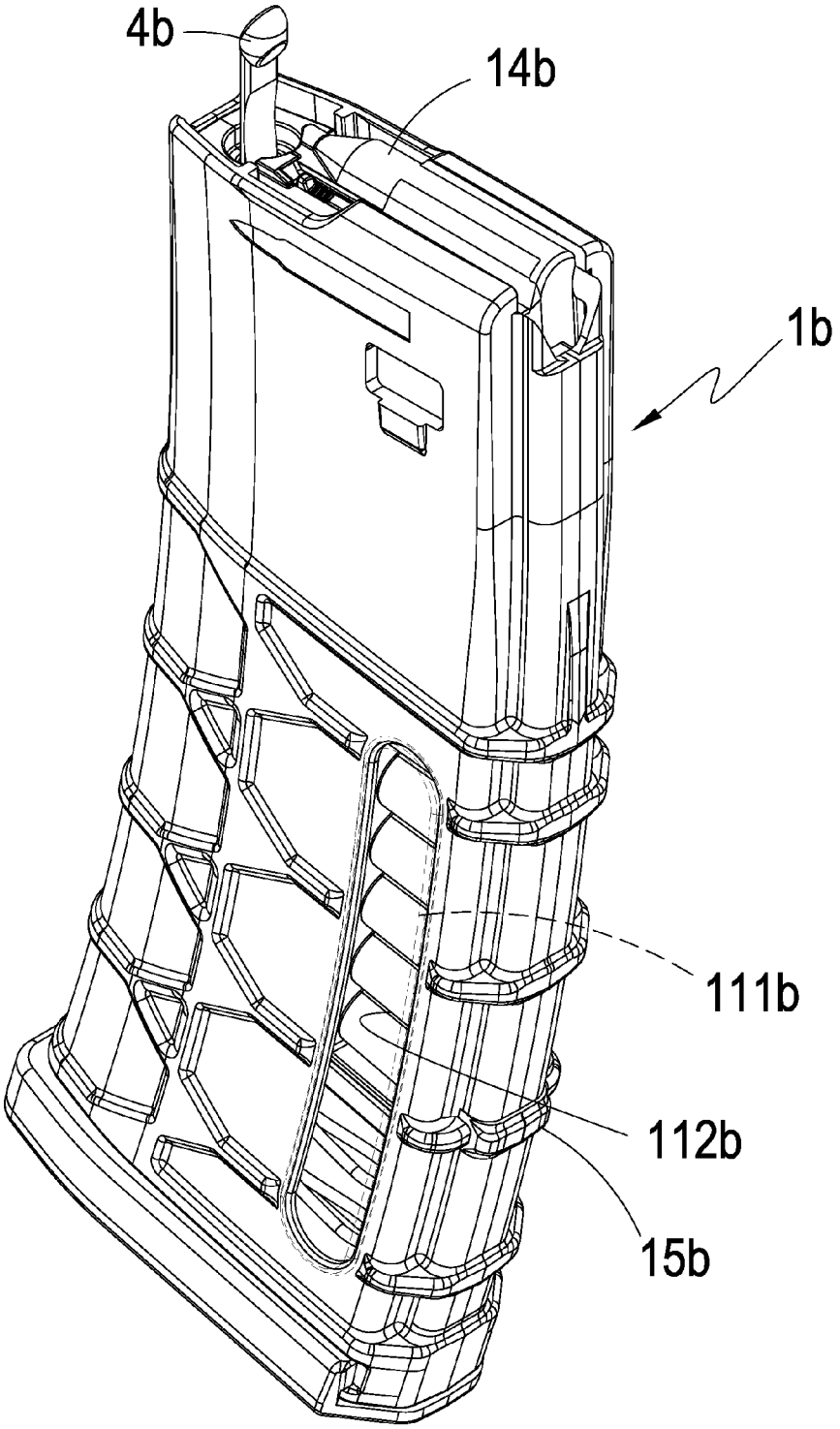
FIG. 9 is a perspective view of a further embodiment of the present invention.
Figure 10:
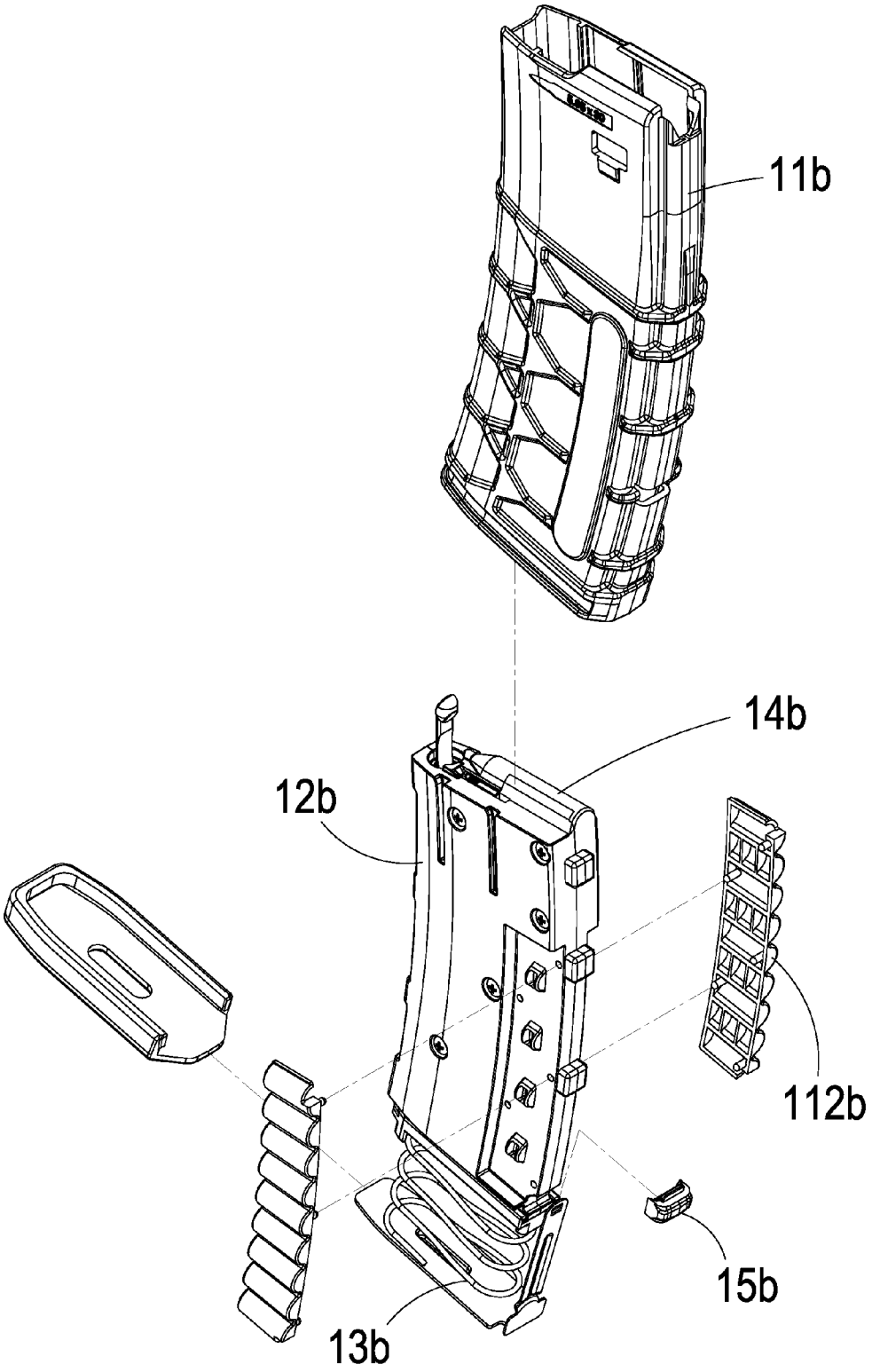
FIG. 10 is an exploded view of said further embodiment of the present invention.

Referring to FIGS. 5-8, it can be seen from FIG. 5 that in this embodiment is constructed by modifying portions of the previous embodiment, wherein the activation element 3*a* comprises a detection magnet and the activation element 3*a* further comprises a magnetic reed switch 31*a* mounted to an installation opening of the true-simulating bullet magazine 1*a*. The activation element 3*a* further comprises a microcontroller 32*a* that is electrically connected to the toy gun and is operable to detect an activation/deactivation condition of the magnetic reed switch 31*a*. Further, a projection section 43*a* is formed on one side of the bullet driving element 4*a* and an engagement section 23*a* is formed on one end of the movable guide bar 2*a* that is distant from the activation element 3*a*. An operation achieved with such modifications will be described. Firstly, referring to FIG. 6, before the true-simulating bullet magazine 1*a* is installed, since the magnetic reed switch 31*a* and the activation element 3*a* are separate from each other so that the microcontroller 32*a* detects such a condition and interrupts the supply of electrical power of the toy gun so that the toy gun does not have power for firing. Then, as shown in FIG. 7, an operation of loading bullets in this embodiment is similar to that of the previous embodiment with the only exception that the projection section 43*a* and the engagement section 23*a* are included to stabilize the operative and driving relationship between the bullet driving element 4*a* and the movable guide bar 2*a*. When the true-simulating bullet magazine 1*a* is installed with bullets loaded therein, the activation element 3*a* and the magnetic reed switch 31*a* are moved to approach each other so that the microcontroller 32*a* detects such a condition and establish connection for electricity supply of the toy gun. When the bullets are used up, as shown in FIG. 8, the subsequent operation is similar to that of the previous embodiment and repeated description will be omitted. Using the activation element 3*a* and the magnetic reed switch 31*a* to serve as a detection based activation device makes it possible to use a less number of components and having a small volume and reduced weight and they are respectively installed in the true-simulating bullet magazine 1*a* and the interior of the gun, causing no damage to the outside appearance so that the overall degree of true-simulation is better, the resistance against wear and abrasion is achieved, the lifespan is extended, the reaction is fast, and activation/deactivation operations are stable, making it an economic and advantageous non-contact sensing device.

Figure 11:
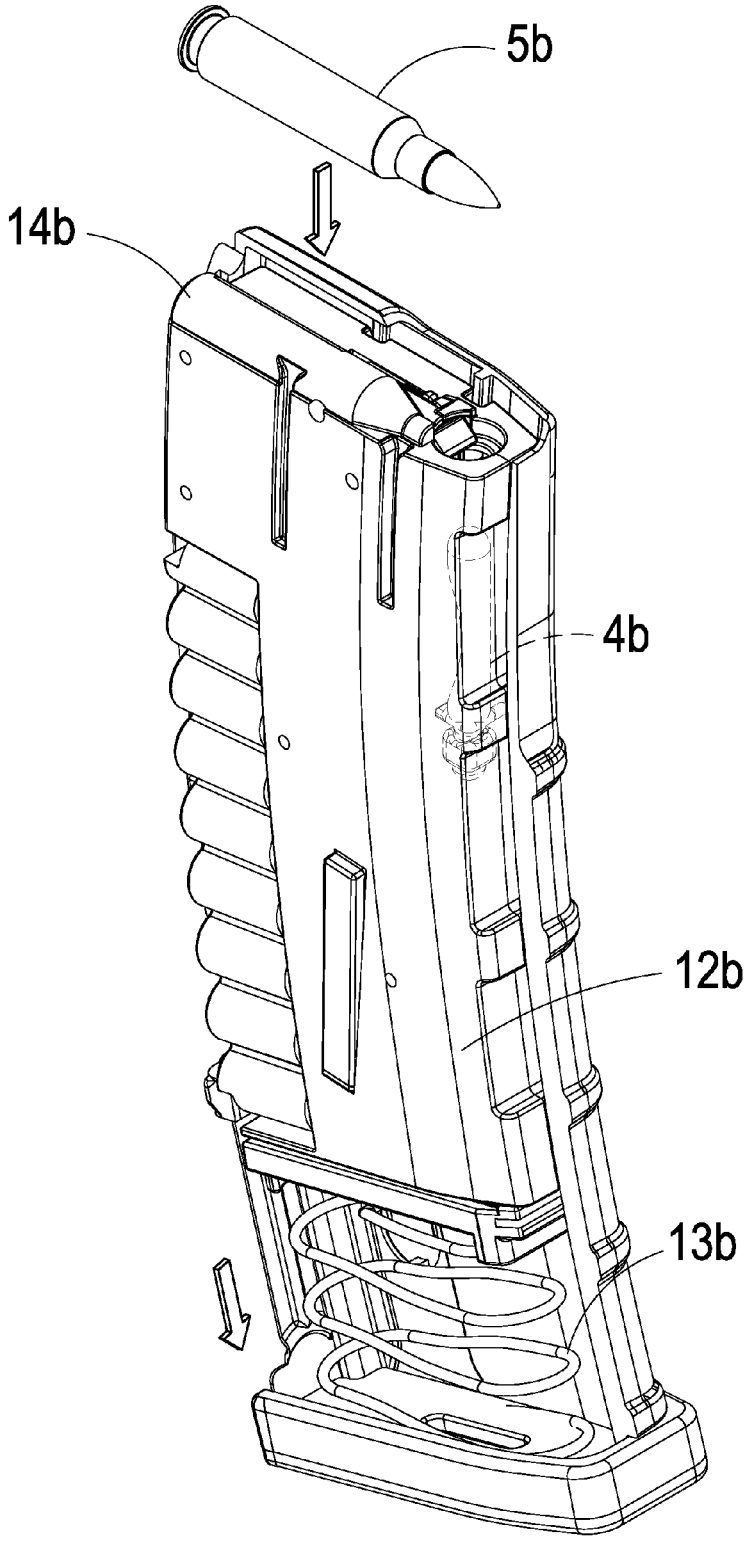
FIG. 11 is a schematic view illustrating an operation of said further embodiment of the present invention.
Figure 12:
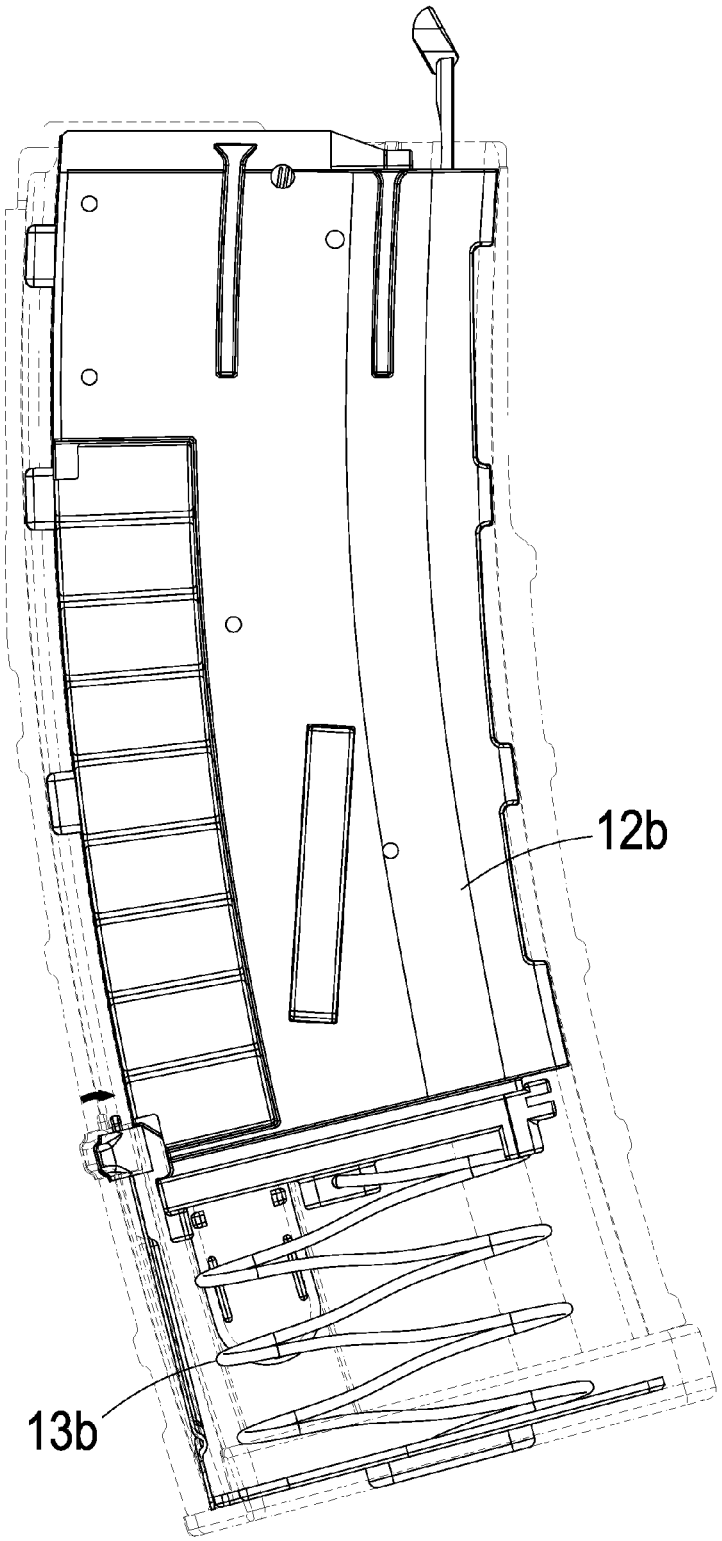
FIG. 12 is another schematic view illustrating the operation of said further embodiment of the present invention.
Figure 13:
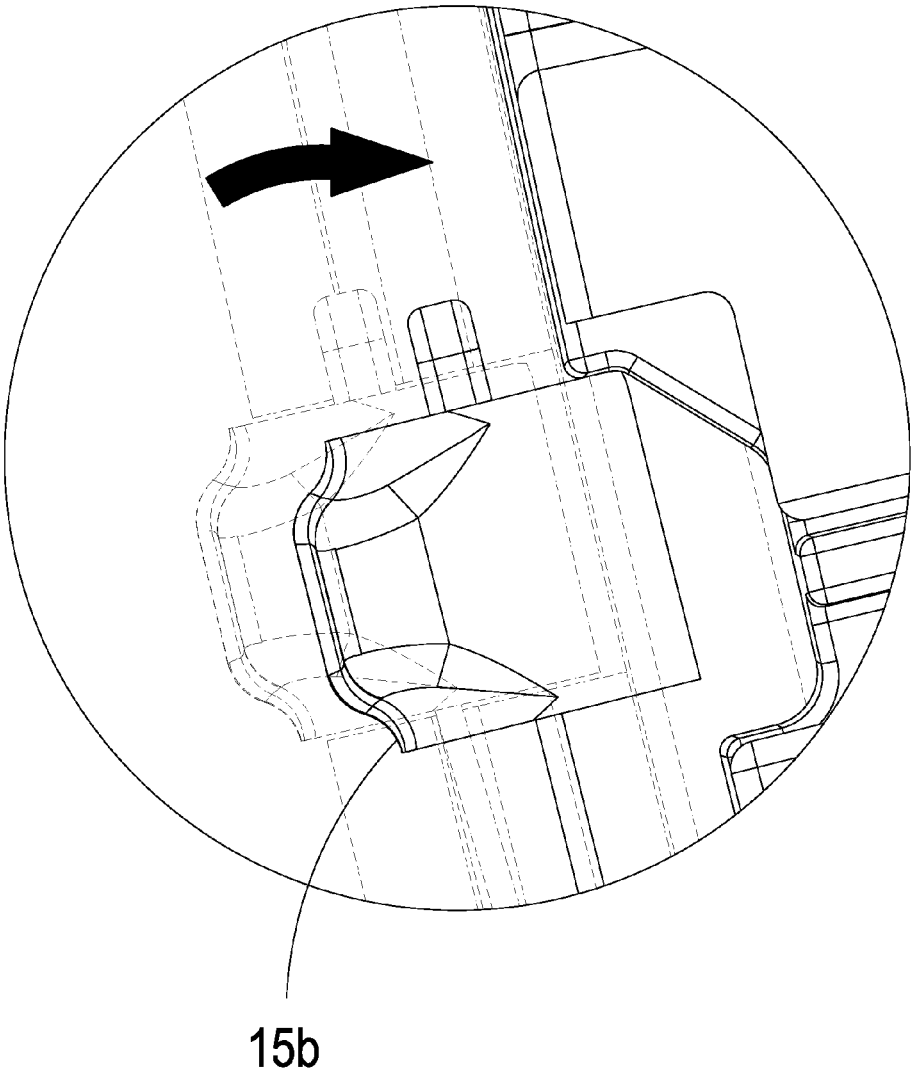
FIG. 13 is an enlarged view of a portion of FIG. 12.

Referring to FIGS. 9-13, to improve the degree of true simulation of a true-simulating bullet magazine 1*b*, firstly, the true-simulating bullet magazine 1*b* comprises an outer casing 11*b* in which an inner casing spring 13*b* is mounted, an inner casing 12*b* that is arranged inside the outer casing 11*b* to be movable upwards/downward with respect thereto and is connected via the inner casing spring 13*b* to a bottom of the outer casing 11*b*, a simulation bullet 14*b*, which is movably arranged in the outer casing 11*b* and is set in contact engagement with an end of the inner casing 12*b* that is opposite to the inner casing spring 13*b*, and a constraint block 15*b*, which is fit, through elastic means, to the outer casing 11*b* to selectively constrain upward/downward movement of the inner casing 12*b*. For visual purposes, the outer casing 11*b* is provided with at least one observation window 111*b* and a false bullet piece 112*b* that is arranged inside the observation window 111*b* and is structured to achieve the purposes of mimicking loading of bullets so that a user is allowed to observe through the observation window 111*b* and perceives a feeling of true loading of bullets into the magazine. Through such an arrangement, as shown in FIG. 11, it can be seen that the simulation bullet 14*b* that is mounted to an upper end of the inner casing 12*b* is arranged for simulate a bullet carrying board of a real bullet magazine in order to enhance the strength and perception of loading a first bullet into the magazine. To operate, the bullet driving element 4*b* is first pressed down into the inner casing 12*b* and at least one decorative bullet 5*b* is then loaded. Loading the decorative bullet 5*b* causes the inner casing spring 13*b* to be compressed so that the inner casing 12*b* is moved downward to achieve the simulation of a true device. To load BB bullets, the decorative bullet 5*b* is removed to thereby resume the initial condition as that shown in FIG. 9, and meanwhile, the constraint block 15*b* is depressed to have it engaging and holding the inner casing 12*b* so as to prevent the inner casing 12*b* from being depressed down due to compression of the inner casing spring 13*b* caused by the operation of loading the BB bullets thereby avoiding unsmooth performance of bullet loading and making the present invention easy and convenient to operate and showing high degree of true simulation.

Thus, with reference to all the drawings, the present invention, when put into use, demonstrates the following advantages over the prior art devices:

(1) The power supply is interrupted when there is no bullet or magazine loaded in order to prevent damage to the mechanisms thereof and also to prevent wasting energy.

(2) An activation element 3 is used to replace the complicated combination of numeral components adopted in the prior art devices so as to reduce cost and simplify assembly.

(3) Adopting the characteristics of a magnetic reed switch 31*a* in the present invention to help improve the development thereof (4) The arrangement of the present invention requires no modification or damage to the outside appearance so that a high degree of true simulation can be achieved in respect of the outside appearance, the feeling of hand, and a perception of careful operation of a true magazine.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A sensing device of a true-simulating bullet magazine, comprising:

a movable guide bar, which is movably mounted in a true-simulating bullet magazine;

an activation element, which is mounted to an end of the movable guide bar to selectively activate/de-activate power required for a firing operation of a toy gun; and a bullet driving element, which is movably arranged in the true-simulating bullet magazine to selectively contact and move the movable guide bar;

wherein the movable guide bar, the activation element, and the bullet driving element are mounted inside an inner casing that has a fixed size and comprises a bullet forward track formed therein and having an opening for receiving bullets loaded therein, the bullet driving element being movably arranged in the bullet forwarding track, the bullet driving element having an end that is opposite to an opening of the bullet forwarding track and is provided with a bullet driving spring attached thereto and biasing the bullet driving element to drive the bullets towards the opening;

wherein the inner casing is movably received in and elastically supported in an outer casing by an inner casing spring mounted to a closed bottom of the outer casing for biasing the inner casing toward an open top end of the outer casing, the outer casing comprising an observation window formed, a false bullet piece having an appearance including a number of false bullets and fixedly attached to the inner casing in such a way that the false bullets are located inside the outer casing and are observable through the observation window; and wherein a true-simulation bullet is selectively receivable in the outer casing through the top open end by pressing down the inner casing against the inner casing spring so as to be held in position between the inner casing and the top open end of the outer casing by means of the inner casing spring.

2. The sensing device of the true-simulating bullet magazine according to claim 1, wherein the activation element comprises a detection magnet and the activation element further comprises a magnetic reed switch mounted to an installation opening that is formed in the toy gun for coupling of the true-simulating bullet magazine to the toy gun in such a way that the detection magnet corresponds to the magnetic reed switch when the true-simulation bullet magazine is coupled to the toy gun.

3. The sensing device of the true-simulating bullet magazine according to claim 2, wherein the activation element further comprises a microcontroller that is electrically connected to the toy gun and is operable to detect an activation/deactivation condition of the magnetic reed switch.

4. The sensing device of the true-simulating bullet magazine according to claim 1, wherein a projection section is formed on one side of the bullet driving element and an engagement section is formed on one end of the movable guide bar that is distant from the activation element.

5. The sensing device of the true-simulating bullet magazine according to claim 1, wherein the movable guide bar comprises a guide bar spring attached thereto and the true-simulating bullet magazine comprises a constraint section mounted therein to constrain a movement range of the movable guide bar.

6. The sensing device of the true-simulating bullet magazine according to claim 1, wherein the outer casing comprises a constraint block mounted thereto in an elastic manner constrain upward/downward movement of the inner casing.

* * * * *